US008161782B2

(12) United States Patent
Håkansson et al.

(10) Patent No.: US 8,161,782 B2
(45) Date of Patent: Apr. 24, 2012

(54) LOCK FOR VENDING MACHINE

(75) Inventors: Carl Johan Håkansson, Stockholm (SE); Ola Hesselvall, Farsta (SE)

(73) Assignee: Cale Access AB, Solna (SE)

( * ) Notice: Subject to any disclaimer, the term of this patent is extended or adjusted under 35 U.S.C. 154(b) by 553 days.

(21) Appl. No.: 12/295,644

(22) PCT Filed: Apr. 2, 2007

(86) PCT No.: PCT/SE2007/050207

§ 371 (c)(1),
(2), (4) Date: Jul. 2, 2009

(87) PCT Pub. No.: WO2007/114784

PCT Pub. Date: Oct. 11, 2007

(65) Prior Publication Data

US 2010/0050705 A1 Mar. 4, 2010

(30) Foreign Application Priority Data

Apr. 3, 2006 (SE) ..... 0600753

(51) Int. Cl.
*E05B 47/00* (2006.01)

(52) U.S. Cl. ..... 70/279.1; 70/208; 70/278.1

(58) Field of Classification Search ..... 70/278.1, 70/278.2, 279.1, 280, 283, 283.1, 208, 209, 70/222, 223

See application file for complete search history.

(56) References Cited

U.S. PATENT DOCUMENTS 3,834,198 A * 9/1974 Wiczer ..... 70/208
4,167,104 A * 9/1979 Bond ..... 70/208
5,091,713 A * 2/1992 Horne et al. ..... 340/541
5,272,894 A * 12/1993 Stillwagon et al. ..... 70/208
5,402,475 A 3/1995 Lesner, Jr. et al.
5,749,253 A 5/1998 Glick et al.
5,791,177 A * 8/1998 Bianco ..... 70/283.1

(Continued)

FOREIGN PATENT DOCUMENTS

DE 20217212 1/2003

(Continued)

OTHER PUBLICATIONS

Supplementary European Search Report for corresponding European Application No. EP-07-74-8368, dated Mar. 25, 2010.

*Primary Examiner* — Suzanne Barrett

(74) *Attorney, Agent, or Firm* — Stites & Harbison PLLC; Douglas E. Jackson

(57) ABSTRACT

A locking system for access to a door of a vending machine includes an opening handle lock for guiding of a movable lock mechanism between a locked position and an unlocked position. An identification unit for electronic identification operates an electronic blocking device that is adjustable between a) an inactive position where it does not actuate the opening handle lock and where the safety lock not may be opened from the outside, and b) an active position where it actuates the opening handle lock such that it may be opened from the outside. The identification unit also controls the electronic blocking device in such a way that a positive identification moves the electronic blocking device to the active position. A safety lock is arranged that may be actuated independently of the identification unit, and by which the movable lock mechanism might be guided between the locked position and the unlocked positions.

2 Claims, 3 Drawing Sheets

U.S. PATENT DOCUMENTS

| | | | | |
|---|---|---|---|---|
| 5,813,257 | A * | 9/1998 | Claghorn et al. | 70/208 |
| 5,848,541 | A | 12/1998 | Glick et al. | |
| 5,930,771 | A * | 7/1999 | Stapp | 705/28 |
| 5,941,107 | A | 8/1999 | Hsu | |
| 5,947,328 | A * | 9/1999 | Kovens et al. | 221/129 |
| 6,082,153 | A * | 7/2000 | Schoell et al. | 70/1.5 |
| 6,575,504 | B2 * | 6/2003 | Roatis et al. | 292/199 |
| 6,581,986 | B2 * | 6/2003 | Roatis et al. | 292/199 |
| 6,615,623 | B1 * | 9/2003 | Ormerod | 70/224 |
| 6,684,671 | B2 * | 2/2004 | Beylotte et al. | 70/208 |
| 7,191,624 | B2 * | 3/2007 | Beylotte et al. | 70/257 |
| 7,296,447 | B2 * | 11/2007 | Priest et al. | 70/208 |
| 2004/0172991 | A1 * | 9/2004 | Forster et al. | 70/257 |
| 2006/0032418 | A1 | 2/2006 | Smith | |

FOREIGN PATENT DOCUMENTS

| | | |
|---|---|---|
| WO | WO 0131597 | 5/2001 |

* cited by examiner

LOCK FOR VENDING MACHINE

FIELD OF THE INVENTION

The invention concerns a lock system for a vending machine, e.g., a parking machine, which shall be accessible for maintenance, such as for emptying of coins, service or filling of articles.

BACKGROUND OF THE INVENTION

Today there are many ways to pay for services and articles. At some machines, paying can be done either with coins, paper money, or with a charge card. Common for most of these types of vending machines are that service staff regularly are either emptying the machine of coins, or filling it with tickets or receipt paper or other types of articles that are provided in the machine, such as e.g., snacks or drinks. The service staff can either get access to the machine by a key or by some type of electronic identification.

One problem with providing access by a key is that if the key goes astray all concerned locks have to be replaced, which of course results in large expenses. If, on the other hand, access is given by electronic identification, there is a dependency on a power supply to get access to the machine.

In the patent specification U.S. Pat. No. 5,402,475, a parking machine is described that automatically communicates with the service staff to tell them when something is wrong with the machine. Every machine in the system can also communicates with a central coordination unit, wherein some functions in the machine may be controlled from a remote location.

In the published patent application US 2006/0032418, a lock for an electric safe is described. The lock consists of both an electronic unit and a mechanical unit that makes it possible to open the electric safe even if the electronic system fails.

SUMMARY OF THE INVENTION

One purpose of the invention is to provide a lock system for a vending machine that is secure, gives easy access, and is accessible even in the absence of electrical current. Such a system is provided by the invention as described hereafter. Preferred embodiments are also made clear by the following detailed description.

According to a first aspect, the invention concerns a locking system for access to a vending machine, such locking system comprising:

an opening handle lock for guiding (moving) of a movable lock means between a locked position and an unlocked position, wherein a door on the vending machine can be opened in the unlocked position, an identification unit for electronic identification, and an electronic blocking device that is adjustable between an inactive position where it does not actuate the opening handle lock and where the opening handle lock can not be opened from the outside, and an active position where it actuates the opening handle lock so it can be opened from the outside, and wherein the identification unit guides (moves) the electronic blocking device in such a way that a positive identification guides the electronic blocking device to the active position.

The locking system comprises also a safety lock which is actuated independently of the identification unit, and by which the movable lock means might be guided between the locked position and the unlocked position.

Preferably the safety lock is arranged so that it directly actuates the movable lock means. In addition it may advantageously be arranged within and in alignment with the opening handle lock so a key may be passed through the opening handle lock to enter the safety lock for actuation of the movable lock means. One advantage of having the safety lock arranged within the opening handle lock is that it gets more difficult to access for manipulation. Because it is located deep inside the machine, it is almost impossible to drill into the safety lock through the opening handle lock because the inner ring is arranged so it rotates together with the drill, which drilling rotation then will not contribute to pull apart the inner ring.

According to a preferred embodiment, the opening handle lock comprises:

an inner ring, as well as an outer sleeve that is arranged so that its rotation guides the movable lock means between a locked position and an unlocked position, as well as a locking rod, wherein the inner ring is arranged inside the outer sleeve, and wherein the locking rod is adjustably arranged between a first position, which is equivalent to the inactive position, where it is neither engaged with the outer sleeve nor with the inner ring and where the inner ring can rotate freely in relation to the outer sleeve, and a second position that corresponds to the active position where it is engaged with both the outer sleeve and the inner ring so that the inner ring only can rotate together with the outer sleeve, whereby rotation of the inner ring is transferred by the outer sleeve to the movable lock means and whereby the electronic blocking device is arranged to actuate the locking rod between the first and second position.

Alternatively, the safety lock can be arranged so it actuates the electronic blocking device so it is possible by means of the safety lock to guide the electronic blocking device to the active position by hand power.

An essential feature of the invention is therefore that the locking system of the machine, which enables entry by the service staff if there is a need, makes it easy to get access to the machine. The identification unit for electronic identification of authorized persons might for example be connected to the card reader of a charge card, so that an authorized person only needs to slide the card and if necessary dial a code to get access to the inside of the machine. Other types of electronic identification is however possible and many different solutions are well known to the person skilled in the art. One advantage with the method of electronic identification is that it makes it possible from the central control station to control and if necessary block the access to a specific identification unit, for example a card, without need to change a lock in another machine.

An acceptable identification of an authorized person makes the machine accessible from the outside, for example when, the accessible opening handle lock is connected to it, as described above, so that the handle can be opened by a simple shaped key that might be used for several different machines. The key itself has therefore a very simple pattern and is useless without the electronic identification means, and no measures must then be taken if the key would get lost in one way or another. If the electronic identification means would get lost, it is, however, important to block access to it. Because the vending machine preferably is provided with a communication unit and a central unit, it is possible to block access from a central location as soon as the means of identification is reported lost.

To avoid that an unauthorized person who gets access to an electronic identification means should get access to coins or other things in a vending machine, the access to the electronic identification means may be dependent on further safety functions. For example, each electronic identification means may be connected to a PIN code, or the access may be limited to a certain interval of time, or the access can be dependent on identification of a user in a further way, e.g., by a cellular telephone. In the case that each single vending machine is not designated to contain money, it can however then be sufficient that the service person only has to be identified by means of a regular card with a magnetic strip. If a card gets lost, it is, as mentioned above, then quickly blocked. Other possible electronic identification means might be a transponder, an RFID, or similar equipment. However, the type of electronic identification means that is used is not limiting of the invention.

One important aspect of the invention is that it should be possible to get access to the vending machine even without using electronic identification means and without that the electronic blocking in the vending machine needing to be inactivated. Thus, there shall be a mechanical or safety lock that is not dependent of power supply. The mechanical opening function may be achieved in many different ways. One possible solution is to provide the vending machine with a separate safety lock that either influences the electronic blocking in such a way that it is activated so it will be possible to open the vending machine with the key having a simple shape, which normally is used in combination with the electronic identification means, or which directly influences the locking rail. Thus every vending machine should be provided with a mechanical or safety lock, to which a main key exists, that is stored in a secure place and that only is designated to be used when it not is possible to open the vending machine in another way, e.g., if there is no power supply to the machine. Where the machine is suitably provided with a battery and when it needs to be changed, and some possible alternative power source also is disabled, there is otherwise no other possibility to access the vending machine.

DETAILED DESCRIPTION OF THE INVENTION

Below a preferred embodiment of the invention will now be described.

Figure 6:
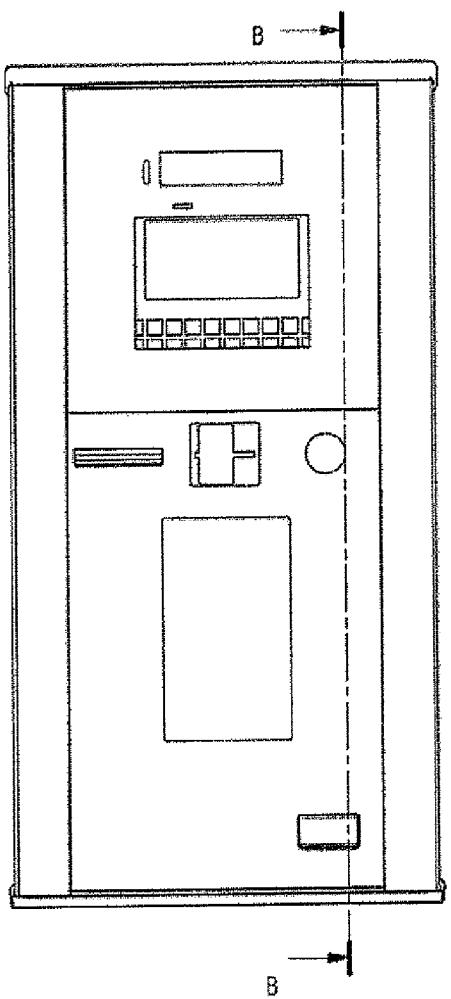
FIG. 6 shows a schematic drawing of a vending machine.
Figure 1:
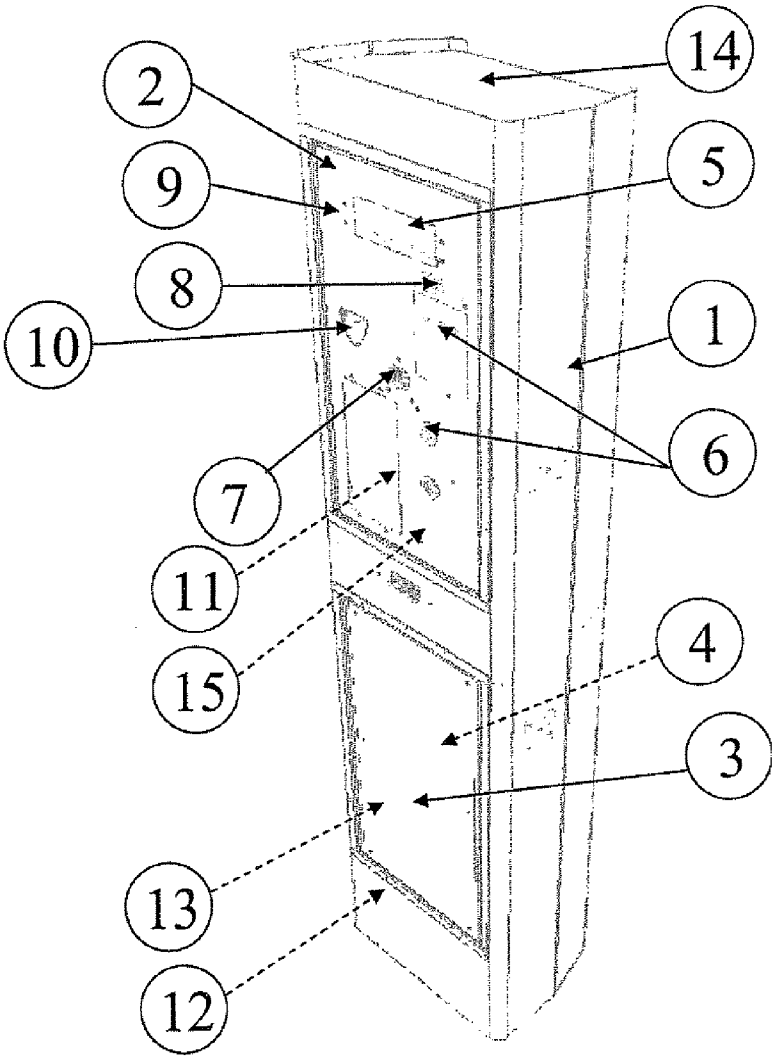
FIG. 1 shows a schematic drawing of a vending machine.

In FIG. 1 there is shown a schematic drawing of an embodiment of the vending machine according to the invention. The vending machine has a housing 1 which may be divisible and which may be provided with lighting. An upper door 2 of the vending machine is provided with a lock, and if desired a lower door 3 may also be provided with a lock. In addition, there is also a door 4 with a lock for a coin box inside thereof and inside of lower door 3. For operation, the vending machine includes a display 5 (or displays), and operating mechanisms 6 such as buttons and touch screens. The vending machine has both a slot for paying with coins or paper money via a coin/paper money reader 7 which includes a return/change feature and a box; and a card reader 8 for paying with card, proxy, magnet, clip, etc. Indications 9 such as an LED or lamp is provided. Furthermore the machine is provided with a central unit, networked CPU 11, for guiding (moving) different units in the machine. Preferably it has also a printer 10 for printing of receipts or tickets, and a communication unit or modem with antenna 15 for communication with a central control station. Power is provided by a battery 12, and a battery charger 13 or other power supply such as a solar panel 14 are provided for maintaining power in battery 12.

Figures 2, 3:
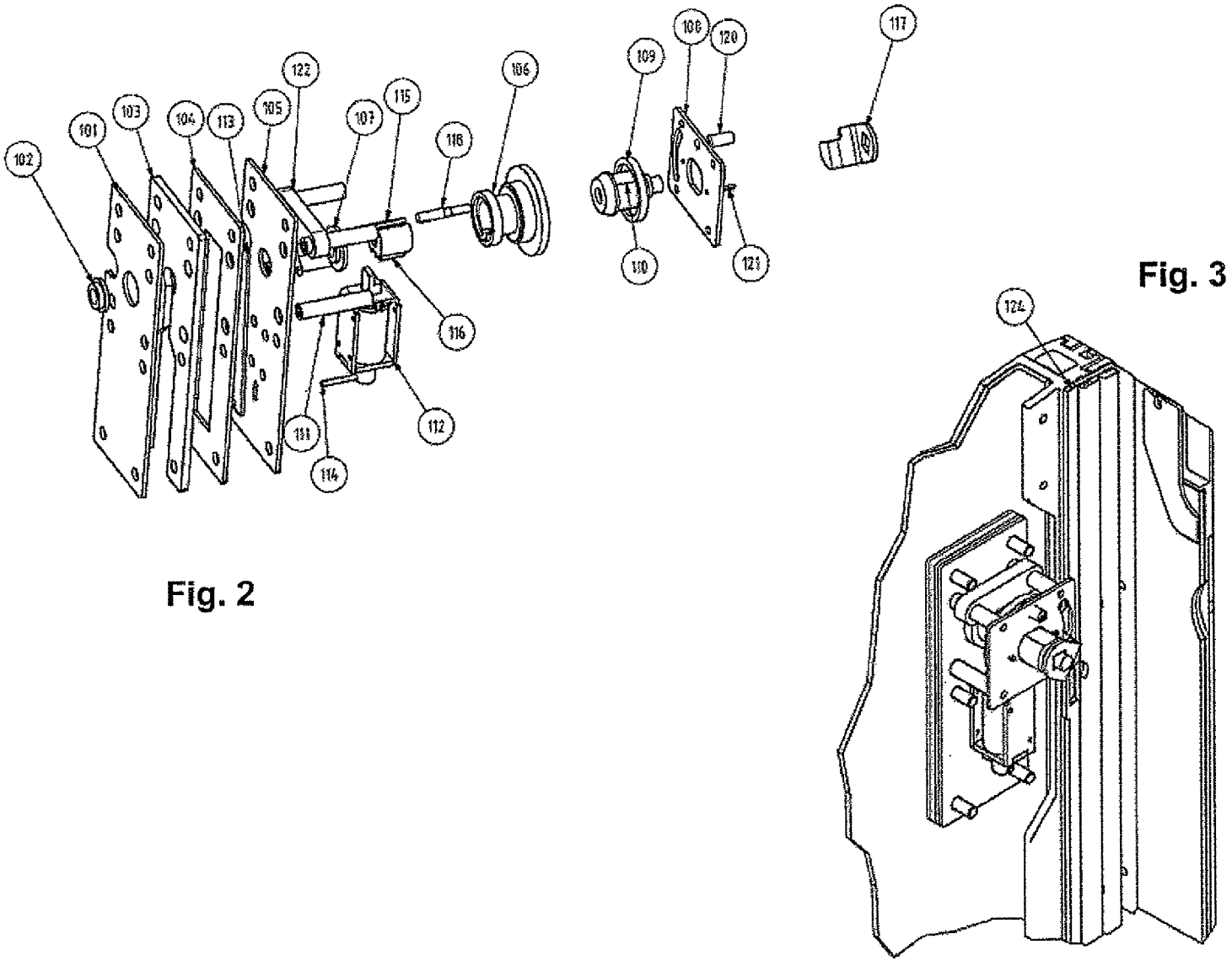
FIG. 2 shows an exploded view of an embodiment of the locking system according to the invention.
FIG. 3 shows a side view of an embodiment of the locking system according to the invention.
Figure 5:
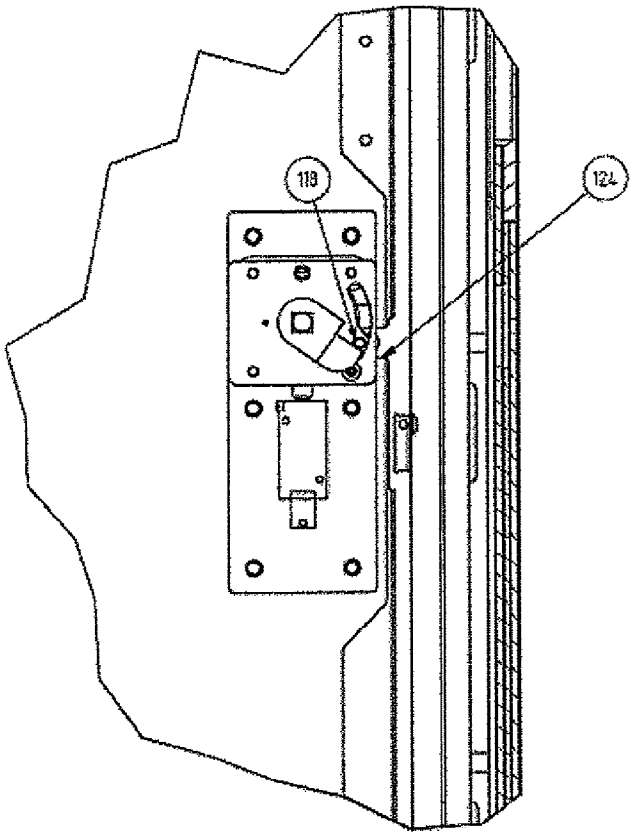
FIG. 5 shows an enlarged view of the selected area in FIG. 4.
Figure 4:
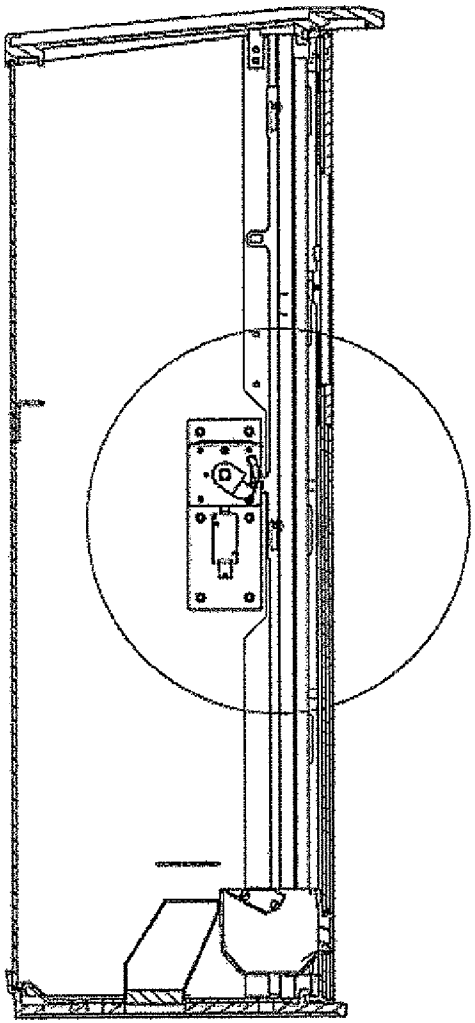
FIG. 4 shows a view of an embodiment of the locking system along the line B-B in FIG. 6.

FIG. 2 shows an exploded view of the locking system according to the invention, which locking system is shown together in FIGS. 3-5. Next to the outside of the pay terminal, an outer sheet 101 is arranged. In the outer sheet 101, a protection 102 against drilling is arranged, through which protection 102 a main key may pass to unlock the safety lock 110 and open the machine. Inside the outer sheet 101 there is arranged in order, an intermediate sheet 103, a door guide 104, and an inner sheet 105. A door 113, which is at least partly preventing access to the key hole in inner sheet 105, is arranged to slide in a rectangular opening in the door guide 104. This door 113 is automatically opened when a correct identification of an authorized operator is made, which will be described in greater detail below. The door 113 is however optional and might be omitted, since no block is actually necessary to prevent keys and similar things from being inserted in the inner cylinder or ring 115. The inner ring 115 is actually disconnected from the rest of the safety lock 110 before correct identification has been made, so it can rotate freely without actuation of the opening function of the safety lock 110. To actuate the locking rail 124 (see FIG. 3), which locking rail 124 is the part that keeps the door 113 of the machine closed, the outer sleeve 106, which is arranged outside the inner ring 115, must actually be turned.

When the service staff wants to get access to the inside of the machine, they start by undertaking an electronic identification. The identification may, as mentioned above, be performed in many different ways. For example, the machine can be designed in such a way that it is sufficient to slide a plastic card with some sort of magnetic strip in the card reader of the machine. Once the identification is done, the operator may enter a handle key (not shown) through the protection of drilling 102 and an outer support 107. The handle key is then slid into, and is engaged with, the inner ring 115.

A blocking device is arranged to get the inner ring 115 engaged with the outer sleeve 106. When an authorized operator has identified himself, the blocking device is activated and it is possible to unlock the opening handle lock with the handle key. The blocking device comprises a bolt (plunger or armature) that is arranged inside a solenoid 112 having a distance sleeve 111. At a correct identification, current is applied to the solenoid 112 pushing the shaped upper side of the bolt or plunger upwards against a locking rod 116. The movement of the bolt is also moving a guiding door rod 114, which is connected to the door 113, to guide (move) this rod 114 upwards so that the key hole in inner sheet 105 can be directly accessible from the outside. Meanwhile the upper side of the bolt is guiding (moving) the first locking rod 116. At the locked position, the first locking rod 116 is arranged in a slot in the outer sleeve 106 without contact with the inner ring 115. But when the bolt is pushed upwards, the first locking rod 116 is positioned between the inner ring 115 and the outer sleeve 106, wherein any possible turning of the inner ring 115 is transmitted to the outer sleeve 106. The outer sleeve 106 is also firmly attached to a second locking rod 118, which extends through a hole (not shown) positioned in the largest diameter of the outer sleeve 106. The second locking rod 118 is anchored in the locking rail 124 (see FIG. 3) and moves it upwards to an opened position. Instead of a locking rail 124, a locking bolt or some other type of lock means known to the person skilled in the art might be used. The invention is therefore not limited to locks with a guide rail.

Behind the inner ring 115 and the outer sleeve 106, a safety lock 110 arranged. The safety lock 110 has an inner support 109 and is arranged in alignment with the inner ring 115 and is accessible by sliding a long and narrow main key through the inner ring 115. The lock 110 is a safety lock since preferably only one main key exists which main key is kept in a secure place, and the main key is only intended to be used in case of emergency, when the opening handle lock because of some reason is disabled. The safety lock 110 is guiding (moving) a turn sheet 117 that is protected behind a back sheet 108 from which a thrush screw 120 and a resilient tension pin 121 extend. The turn sheet 117 is arranged in engagement with the extension of the second locking rod 118, such that turning by this turn sheet 117 can guide (move) the locking rail 124 to an opened position.

It is of course possible to arrange the engagement of the safety lock with the locking rail in other ways. It is, e.g., not necessary that it actuates the same locking rod 118, which is actuated by the opening handle lock. Instead it might, e.g., be arranged so it directly actuates the locking rail 124.

The invention claimed is:

1. A locking system for providing access to a vending machine through a door of the vending machine, said locking system comprising:

an opening handle lock for moving of a movable door lock mechanism between a locked position and an unlocked position, whereby in the unlocked position of the movable door lock mechanism the door on the vending machine may be opened, an identification unit which recognizes an electronic identification, an electronic blocking device that is adjustable between a) an inactive position where the electronic blocking device does not affect the opening handle lock and where the first lock may not be opened from the outside, and b) an active position where the electronic blocking device affects the opening handle lock such that the opening handle lock may be opened from the outside, the positions of the electronic blocking device being controlled by the identification unit such that a positive identification adjusts the electronic blocking device to the active position, a safety lock that may be actuated independently of the identification unit and by which the movable door lock mechanism is moved between the locked position and the unlocked position, the safety lock being arranged within and in alignment with the opening handle lock such that a key may pass through the opening handle lock to enter the safety lock to actuate the movable door lock mechanism, wherein the opening handle lock comprises an inner ring, an outer sleeve that is arranged so that a rotation thereof moves guides the movable door lock mechanism between the locked position and the unlocked position, and a locking rod, wherein the inner ring is arranged inside the outer sleeve, and wherein the locking rod is adjustably arranged for movement between a) a first position, which corresponds to the inactive position where the locking rod is not engaged with both the outer sleeve and the inner ring, and where the inner ring will rotate freely in relation to the outer sleeve, and b) a second position which corresponds to the active position where the locking rod is engaged with both the outer sleeve and the inner ring so that the inner ring will only may rotate together with the outer sleeve, whereby wherein any rotation of the inner ring is transferred from the inner ring by via the outer sleeve to the movable door lock mechanism, and wherein the electronic blocking device is arranged to actuate the locking rod between the first and second positions.

2. A locking system according to claim 1, wherein the safety lock is arranged to directly actuates the movable door lock mechanism.

* * * * *